US008237618B2

(12) United States Patent
Wu

(10) Patent No.: US 8,237,618 B2
(45) Date of Patent: Aug. 7, 2012

(54) SLOT-FED YAGI AERIAL

(75) Inventor: Jinbo Wu, Guangdong (CN)

(73) Assignee: Shenzhen Grentech Co., Ltd., Shenzhen, Guangdong (CN)

( * ) Notice: Subject to any disclaimer, the term of this patent is extended or adjusted under 35 U.S.C. 154(b) by 359 days.

(21) Appl. No.: 12/672,849

(22) PCT Filed: Aug. 12, 2008

(86) PCT No.: PCT/CN2008/001451
§ 371 (c)(1),
(2), (4) Date: Feb. 9, 2010

(87) PCT Pub. No.: WO2009/021403
PCT Pub. Date: Feb. 19, 2009

(65) Prior Publication Data

US 2011/0163931 A1 Jul. 7, 2011

(30) Foreign Application Priority Data

Aug. 16, 2007 (CN) ..... 2007 1 0075774

(51) Int. Cl.
*H01Q 19/30* (2006.01)

(52) U.S. Cl. ..... 343/819; 343/818; 343/815; 343/817

(58) Field of Classification Search ..... 343/815, 343/817, 818, 819, 833, 834
See application file for complete search history.

(56) References Cited

U.S. PATENT DOCUMENTS

| | | | | |
|---|---|---|---|---|
| 4,028,709 | A * | 6/1977 | Berkowitz et al. | 343/819 |
| 4,218,686 | A * | 8/1980 | Blonder | 343/819 |
| 5,625,367 | A * | 4/1997 | Unwin | 343/745 |
| 6,606,074 | B1 * | 8/2003 | Allnutt | 343/815 |
| 6,677,914 | B2 * | 1/2004 | Mertel | 343/815 |
| 7,626,557 | B2 * | 12/2009 | Eckwielen et al. | 343/757 |

* cited by examiner

*Primary Examiner* — Hoang V Nguyen
(74) *Attorney, Agent, or Firm* — Jackson IPG PLLC

(57) ABSTRACT

A slot-fed Yagi aerial includes: a cable, a reflector, an active dipole and directors, wherein, the reflector, the active dipole, etc. are provided on a support tube; the feeding section of the Yagi aerial is of a shielded slot structure in which the distance between the ends of the slot is approximately one half of the wavelength of the electromagnetic signal desired to be received; the two pieces of thin metal rods composing the half wavelength dipole are located at two external sides of the slot; the outer conductor of the cable is connected to one side of the slot, and the inner conductor of the cable is connected to the other side of the slot or the inner conductor of the cable isolated by a dielectric layer is wound around at the other side of the slot, so as to realize a direct connection feed or a coupling feed. The slot-fed Yagi aerial employs a half wavelength dipole composed of two pieces of thin metal rods, and its feeding section is of a shielded slot structure, and its feeding is realized by the slot. After simulation test and examination, the Yagi aerial according to the present invention can provide a better gain and front-to-rear ratio over a folded dipole in the case that they have same size, so that the production cost is saved and the occupation space of the aerial is reduced while the gain and the front-to-rear ratio is maintained.

11 Claims, 3 Drawing Sheets

SLOT-FED YAGI AERIAL

FIELD OF THE INVENTION

The present invention involves the technology of microwave communication, particularly involves a slot-fed Yagi aerial employing a shielded slot structure.

BACKGROUND OF THE INVENTION

In 1920s, Yagi Hidetsugu and Uda Shintarou of Tohoku University in Japan invented an aerial that is later named as "Yagi-Uda aerial", and also named as "Yagi Aerial" for short. Yagi aerial is still used a lot until now, because it has good directionality and can provide a better gain than dipole aerial, and the effect of long distance communication is especially good to do direction-finding with Yagi aerial. A typical Yagi Aerial should have three pairs of dipoles, and the three pairs of dipoles are parallel in a same plane. The pair of dipoles connected to the cable is called as active dipole, or called as main dipole, which is the middle one of the three pair of dipoles. The pair of dipoles that is a little longer than the active dipole is called as reflector, which is located at one side of the active dipole and has the function of weakening the radio wave received from the side or sent out from the side; the pair of dipoles that is a little shorter than the active dipole is called as director, which is located at the other side of the active dipole and has the function of enhancing the radio wave received from the other side or sent out from the other side; wherein, the quantity of the director may be plural; a support tube is located at the middle of the reflector, the active dipole, and the director, which is vertical to them and has the function of supporting and fixing them.

In modern life and engineering, varied dipole forms can be used as the active dipole of a Yagi aerial; wherein, the most common active dipole is half wavelength symmetrical dipole and half wavelength folded dipole; moreover, in an engineering aerial, for being restricted by the impedance characteristic of the two dipole types themselves, the half wavelength folded dipole is most common to be used as the active dipole of a Yagi aerial. In a Yagi aerial that uses the half wavelength folded dipole as the active dipole, the feeding structure mainly utilizes the structure of the Yagi aerial itself; for example, in the compact feeding method of penetrating type, the cable is penetrated via the support tube, and through the elbow pipe of the folded dipole strides over the feeding point, to connect the inner conductor of the cable to the opposite folded dipole; for being restricted by the structure, if a comparatively higher gain and front-to-rear ratio are needed, this kind of Yagi aerial must be made big enough, which will lead to the increasing of the production cost, the occupation space, etc. The half wavelength symmetrical dipole is also called as half wavelength dipole; for being restricted by the impedance characteristic of itself, the half wavelength dipole is usually used in a civil homemade Yagi aerial, which can not achieve the parameter requirement of an engineering aerial.

SUMMARY OF THE INVENTION

The object of the present invention is to overcome the disadvantages of the above mentioned conventional art by providing a slot-fed Yagi aerial, which employs a shielded slot structure to realize the feed of the Yagi aerial, and the Yagi aerial according to the present invention can provide a better gain and front-to-rear ratio over a traditional folded dipole Yagi aerial in the case that they have same size.

The slot-fed Yagi aerial of the present invention is realized as the following. The slot-fed Yagi aerial includes: a cable, a reflector, an active dipole and at least one director, wherein, the reflector, the active dipole, and the director are in turn separately arranged on a support tube from its one end; the feeding section of the Yagi aerial is of a shielded slot structure in which the distance between the ends of the slot is approximately one half of the wavelength of the electromagnetic signal desired to be received; the active dipole is a half wavelength dipole comprising two pieces of thin metal rods, and the two pieces of thin metal rods are separately located at the two external sides of the slot; the outer conductor of the cable is connected to one side of the slot, and the inner conductor of the cable is connected to the other side of the slot or the inner conductor of the cable isolated by a dielectric layer is wound around at the other side of the slot, so as to realize a direct connection feed or a coupling feed.

Wherein, the shielded slot structure comprises a metal pillar with its middle being provided with a slot; the metal pillar is fixed in the support tube and is shielded by the support tube; a clearance is provided between the slot section of the metal pillar and the inner wall of the tube body of the support tube at the position corresponding to the slot section; the two pieces of thin metal rods of the half wavelength dipole are separately connected to the two external sides of the slot section of the metal pillar; the outer conductor of the cable is connected to one side of the slot, and the inner conductor of the cable is connected to the other side of the slot or the inner conductor of the cable isolated by a dielectric layer is wound around at the other side of the slot.

The shielded slot structure can also be composed of a slot provided on the support tube and a metal shield cover surrounding the slot; a clearance is provided between the slot section of the support tube and the inner wall of the metal shield cover; the two pieces of thin metal rods of the half wavelength dipole are separately connected to the two external sides of the slot section of the support tube; the outer conductor and the inner conductor of the cable are separately connected to the two sides of the slot, so as to realize a direct connection feed.

The difference between the above mentioned two kinds of shielded slot structures is because of the slot being located at different positions. The slot of the former is located on the metal pillar fixed inside the support tube, and the slot is shielded by the support tube itself; the slot of the latter is located at the position where the half wavelength dipole is located on the support tube, and the slot is shielded by a metal shield cover; the two slot structures can achieve the same effect. By exciting the slot of approximately one half of the wavelength, the two kinds of shielded slot structure both can realize exciting the active dipole of the Yagi aerial, so as to realize the feeding process of Yagi aerial, and to realize the radiation function of Yagi aerial.

In the above mentioned slot structures, when the condition of the slot being approximately one half of the wavelength is achieved, the slot can be selected from different shapes, such as a linear slot, a S-shaped slot, and an arch shape slot.

In the above mentioned slot structures, the slot may be filled with insulating medium, for example, polyethylene; after filling, the transmission speed of radio wave is changed, so, the total length of the aerial can be reduced, and the aerial weight is accordingly reduced; moreover, the aerial structure is more reliable, and the cost is saved.

The present invention employs two pieces of thin metal rods to compose the half wavelength dipole of a Yagi aerial, and the feeding section is a shielded slot structure; a direct connection feed or a coupling feed is realized via the slot.

After simulation test and examination, the Yagi aerial according to the present invention can provide a better gain and front-to-rear ratio over a traditional folded dipole in the case that they have same size, so that the production cost is saved and the occupation space of the aerial is reduced while the gain and the front-to-rear ratio is maintained.

DESCRIPTION OF THE PREFERRED EMBODIMENT

The present invention is described detailedly with reference to the following preferred embodiments.

The First Embodiment

Figure 1:
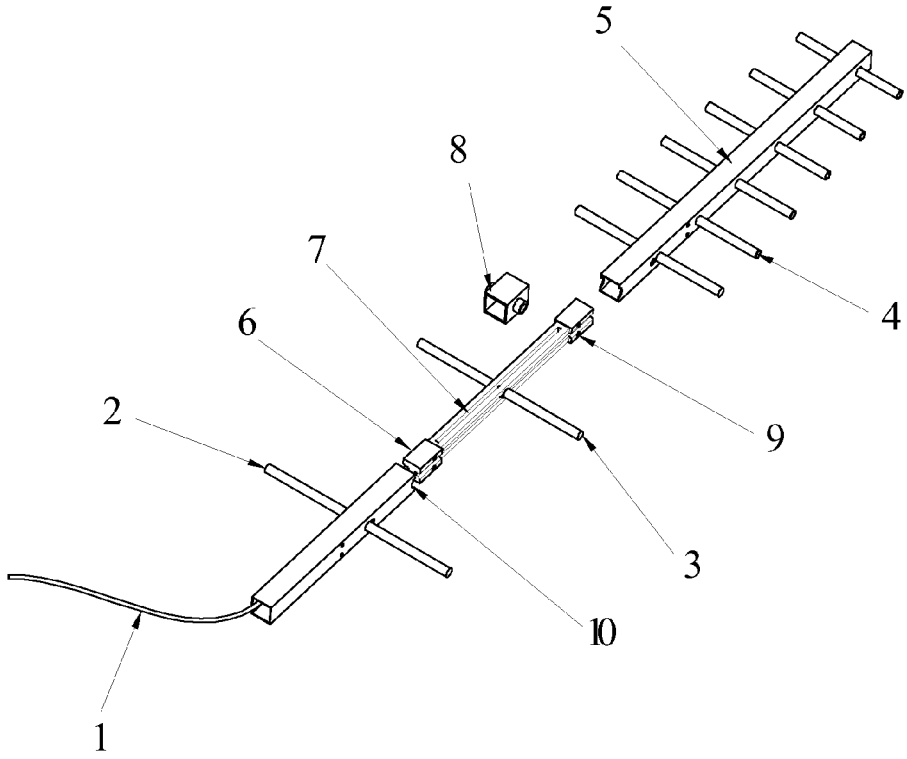
FIG. 1 is an exploded schematic diagram of the first embodiment of the present invention.
Figure 2:
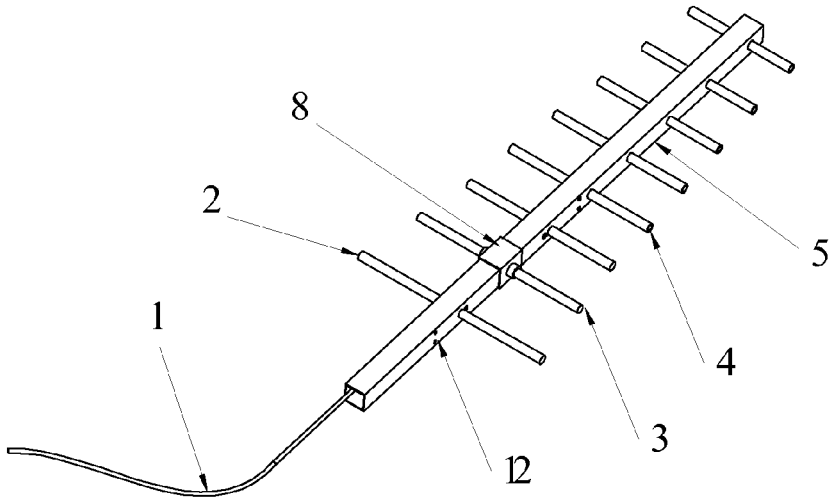
FIG. 2 is an assembled stereo schematic diagram of FIG. 1.
Figure 3:
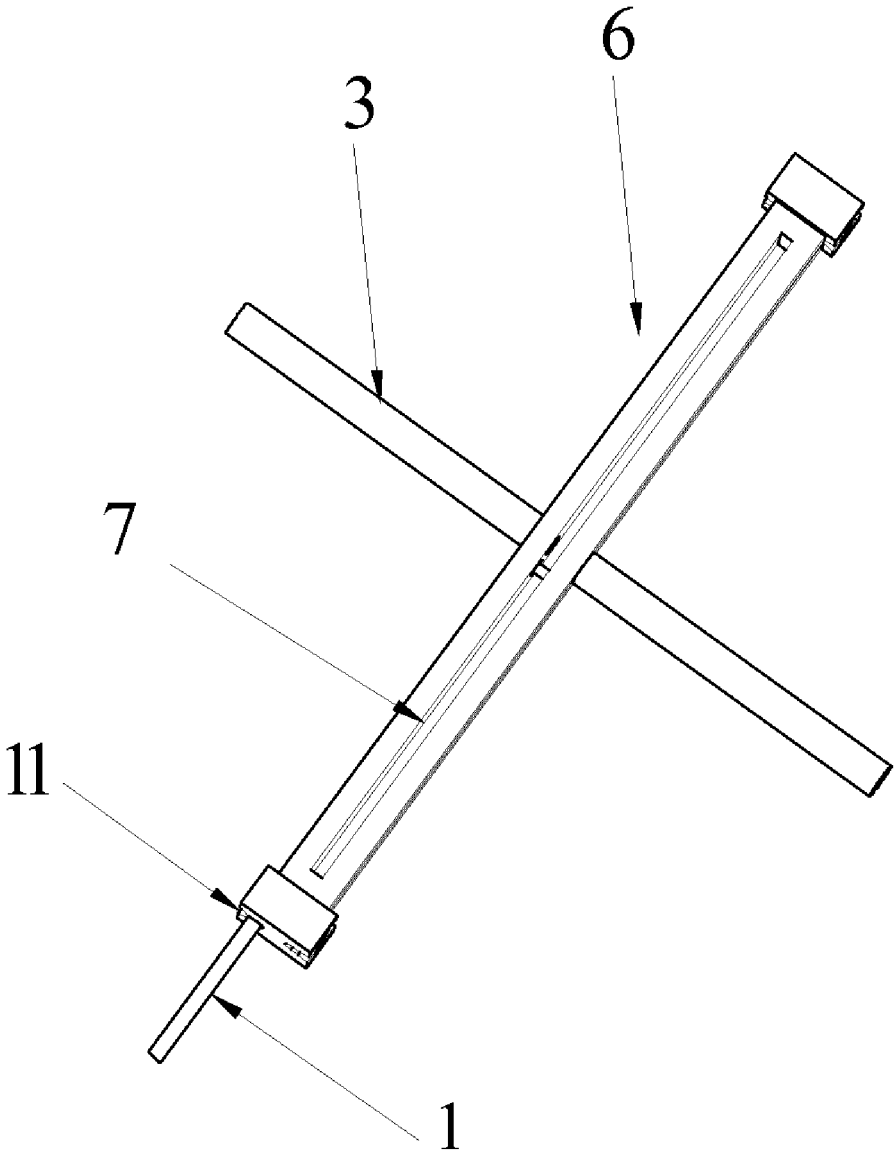
FIG. 3 is a schematic diagram of combining the metal pillar having a slot with the half wavelength dipole and the cable in FIG. 1.

FIGS. 1-3 are schematic diagrams about the first embodiment of the present invention. As shown in FIGS. 1-3, the slot-fed Yagi aerial of the first embodiment comprises basic units such as a cable 1, a reflector 2, an active dipole 3 and six directors 4, wherein, the reflector 2, the active dipole 3, and the six directors 4 are in turn separately arranged on a metal support tube 5 from its one end; the active dipole 3 is a half wavelength dipole, and the feeding section of the Yagi aerial is a shielded slot structure. In this Yagi aerial, the parameters of each unit is the same with the parameters of a traditional Yagi aerial; if the wavelength of the electromagnetic signal desired to be received is λ, then the length of the reflector 2 is a little longer than ½λ, and the length of the active dipole 3 is approximately ½λ, and the length of the directors 4 is a little shorter than ½λ, and the distance between each adjacent two units is approximately ¼λ.

Wherein, the shielded slot structure comprises a metal pillar 6 with its middle being provided with a slot 7; the metal pillar 6 is fixed in the support tube 5 and is shielded by the support tube 5; a clearance is provided between the slot section of the metal pillar 6 and the inner wall of the tube body of the support tube 5 at the corresponding position; wherein, the slot 7 is a linear slot, and is penetrating up and down; the length of the slot is approximately one half of the wavelength of the electromagnetic signal desired to be received; one side of the slot 7 is connected to the outer conductor of the cable 1, and the other side is connected to the inner conductor of the cable 1 or realizes a coupling feed with the inner conductor of the cable 1 via a dielectric layer.

The two ends of the metal pillar 6 with the slot 7 are designed as support parts to be adaptive for the support tube 5; the size of the support part is a little bigger than the middle part of the metal pillar 6 with the slot 7, and the support parts are beforehand provided with fixing holes 9; the two sides of the metal pillar 6 had better be provided with grooves 11 for the cable 1 to be led out. The support parts at the two ends of the metal pillar 6 are big and the middle of the metal pillar 6 is small, so, after the metal pillar 6 being fixed inside the support tube 5, a certain clearance can be provided between the support tube 5 and the slot section of the metal pillar 6 to make them not contact each other (if they contact each other, the clearance will be blocked to lose its function that it should have); the grooves 11 located at the two sides of the metal pillar 6 are convenient for the cable 1 to be led out. The fixing holes 9 beforehand provided at the support parts of the two ends of the metal pillar 6 are corresponding to the fixing holes 12 of the support tube 5, so, the metal pillar 6 can be fixed inside the support tube 5 via fasteners such as bolts.

The design of providing grooves 11 at the two sides of the metal pillar 6 with the slot 7 is convenient for fixing and connecting the cable 1; the slot 7 can be excited by two methods, wherein, one method is to directly excite the slot 7, and the other method is to excite the slot 7 by coupling. While directly exciting the slot 7, the cable 1 passes through the groove 11 at one side of the metal pillar 6, and the outer conductor of the cable 1 is connected to one side of the slot 7, and the inner conductor of the cable 1 is directly connected to the other side of the slot 7. While adopting coupling method to excite the slot 7, the cable 1 passes through the groove 11 at one side of the metal pillar 6, and the outer conductor of the cable 1 is connected to the side of the slot 7, and the inner conductor part with a dielectric layer of the cable 1 passes through the slot 7 to be wound around the groove 11 at the other side of the metal pillar 6, so as to realize a coupling feed.

In the first embodiment, the parameters of the active dipole 3 is the same with the parameters of the half wavelength dipole used in traditional Yagi aerials, and the length of the half wavelength dipole is approximately one half of the wavelength of the electromagnetic signal desired to be received. But, the half wavelength dipole comprises two pieces of thin metal rods, and the length of each piece is approximately a quarter of the wavelength of the electromagnetic signal desired to be received; the two pieces of thin metal rods are separately connected to the two external sides of the slot section of the metal pillar 6; the opposite positions at the two sides of the support tube 5 are provided with via holes 10 for the corresponding thin metal rod to be led out, and the two pieces of thin metal rods of the half wavelength dipole do not contact the support tube. To work effectively, as the thin metal rod passes through the side wall of the support tube 5, the thin metal rod need to keep not contacting the support tube 5, so, the inner diameter of the via holes 10 located at the two sides of the support tube 5 for the thin metal rods to pass through need to be big enough, and at least to be more than the diameter of the thin metal rods.

For the convenience of fixing the metal pillar 6 with the slot inside the support tube 5, the support tube 5 can be broken at the position of the via holes 10 for the thin metal rods, and an additional plastic casing pipe 8 is provided at the broken position for connection and waterproof function. After the metal pillar 6 is easily put inside the support tube 5, the two broken parts of the support tube 5 can connect each other by being covered with the plastic casing pipe 8, and moreover, for example, rainwater can be prevented from going into the support tube 5.

During the installation process of the first embodiment, if the distance between the reflector 2 and the first director of the Yagi aerial is less than the length of the slot 7, for keeping the valid electric length of the cavity formed by the support tube 5 and the middle part of the metal pillar 6, at least one of the reflector 2 and the first director is needed to be attached to the outer wall of the support tube 5 and to keep not contacting the middle part of the metal pillar 6.

In the present embodiment, insulating medium is filled into the slot 7, for example, polyethylene plastic; after filling, the transmission speed of radio wave is changed, so, the total length of the aerial can be reduced, and the aerial weight is accordingly reduced; moreover, the aerial structure is more reliable, and the cost is saved. While the condition of the slot being approximately one half of the wavelength is achieved, the slot 7 can be changed to other shapes, such as the linear slot shown in FIGS. 1-3, a S-shaped slot, and an arch shape slot, or can be a slot of other similar shapes; the distance (or effective electric length) between the two ends of the slots of different shapes needs to be approximately one half of the wavelength of the electromagnetic signal desired to be received; the width of the slot has no influence to the present invention, and in the specific experiments, the slot with its width being between 1 mm and 5 mm can all match the design requirements. If the engineering requires not too much about the standing-wave ratio and the bandwidth, thus in the present embodiment, the upper part of the metal pillar can be taken off, which can also achieve the directional diagram bandwidth of the conventional Yagi aerial. At this time, the slot structure is changed into a shielded balancer.

The Second Embodiment

Figure 4:
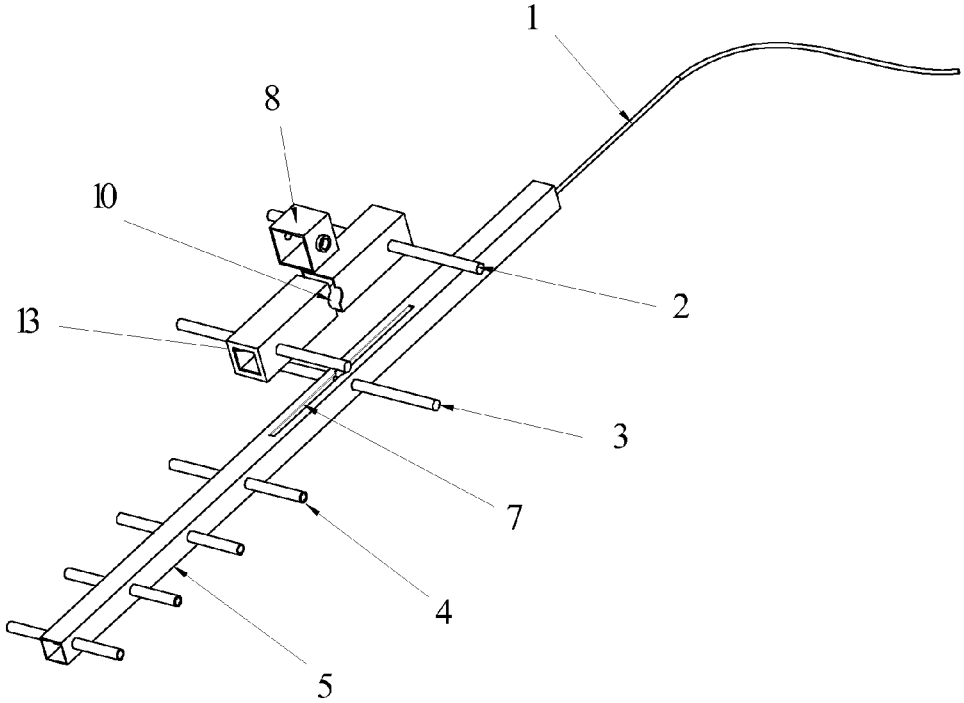
FIG. 4 is an exploded schematic diagram of the second embodiment of the present invention.
Figure 5:
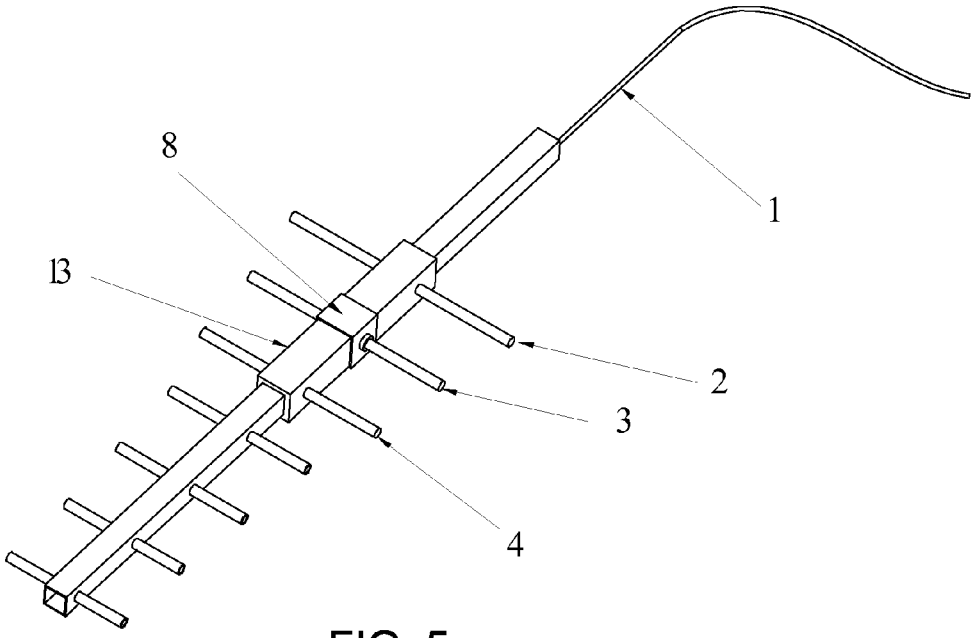
FIG. 5 is an assembled stereo schematic diagram of FIG. 4.

Referring to FIGS. 4-5, the basic structure of the Yagi aerial of the second embodiment is the same with the first embodiment, and the function is also the same, wherein, the shielded slot structure used in the second embodiment is different. Wherein, the shielded slot structure is composed of the slot 7 provided on the support tube 5 and the metal shield cover 13 surrounding the slot 7; a clearance is provided between the slot section of the support tube 5 and the inner wall of the metal shield cover 13; wherein, the slot 7 is a linear slot, and is penetrating up and down; the length of the slot is approximately one half of the wavelength of the electromagnetic signal desired to be received; one side of the slot 7 is connected to the outer conductor of the cable 1, and the other side is connected to the inner conductor of the cable 1 to realize a direct connection feed.

For forming the clearance between the slot section of the support tube 5 and the inner wall of the metal shield cover 13 to keep them not contact, as shown in FIG. 4, the two end openings of the metal shield cover 13 can be shrunk, so as to make the size of its two end openings less than the slot section of the support tube 5. For the position of the slot 7 is changed, the two pieces of thin metal rods of the active dipole 3 are separately connected to the two external sides of the slot section of the support tube 5; the opposite positions at the two sides of the metal shield cover 13 are provided with via holes 10 for the corresponding thin metal rod to be led out; the inner diameter of the via holes 10 need to be big enough, and at least to be more than the diameter of the thin metal rods, so as to keep the Yagi aerial working effectively. The metal shield cover 13 can also be broken at the position of the via holes 10 for the thin metal rods, and an additional plastic casing pipe 8 is provided at the broken position for connection and waterproof function.

During the installation process of the second embodiment, if the distance between the reflector 2 and the first director of the Yagi aerial is less than the length of the metal shield cover 13, for keeping the valid electric length of the cavity formed by the support tube 5 and the metal shield cover 13, at least one of the reflector 2 and the first director is needed to be attached to the outer wall of the metal shield cover 13 and to keep not contacting the support tube 5.

In the above mentioned two specific embodiments, the internal slot structure and the external slot structure can achieve the same effect, and by exciting the slot of approximately one half of the wavelength, the two kinds of shielded slot structure can realize the feeding process of Yagi aerial, and can realize the radiation function of Yagi aerial. After simulation test and examination, the Yagi aerial having the two kinds of shielded slot structure can provide a better gain and front-to-rear ratio over a folded dipole in the case that they have same size.

Although the present invention has been described in detail with above said preferred embodiments, but it is only to make the people skilled in the art to understand the present invention, not to limit the scope of the present invention. For those skilled in the art, all the modifications and changes according to the characteristic and spirit of the present invention, are involved in the protected scope of the present invention.

What is claimed is:

1. A slot-fed Yagi aerial comprising a cable, a reflector, an active dipole, and at least one director; the reflector, the active dipole, and the director being in turn separately arranged on a support tube from its one end; the active dipole being a half wavelength dipole, wherein the feeding section of the Yagi aerial is a shielded slot structure, and the distance between the two ends of the slot is approximately one half of the wavelength of the electromagnetic signal desired to be received; two pieces of thin metal rods composes the half wavelength dipole, and are separately located at the two external sides of the slot; the outer conductor of the cable is connected to one side of the slot, and the inner conductor of the cable is connected to the other side of the slot or the inner conductor of the cable isolated by a dielectric layer is wound around at the other side of the slot, so as to realize a direct connection feed or a coupling feed.

2. The slot-fed Yagi aerial of claim 1, wherein the shielded slot structure comprises a metal pillar with its middle being provided with a slot; the metal pillar is fixed in the support tube and is shielded by the support tube; a clearance is provided between the slot section of the metal pillar and the inner wall of the tube body of the support tube at the position corresponding to the slot section.

3. The slot-fed Yagi aerial of claim 2, wherein the two pieces of thin metal rods of the half wavelength dipole are separately connected to the two external sides of the slot section of the metal pillar; the opposite positions at the two sides of the support tube are provided with via holes for the corresponding thin metal rod to be led out.

4. The slot-fed Yagi aerial of claim 3, wherein the support tube is broken at the position of the via holes for the thin metal rods, and an additional plastic casing pipe is provided at the broken position for connection and waterproof function.

5. The slot-fed Yagi aerial of claim 3, wherein the two ends of the metal pillar with the slot are provided with support parts to be adaptive for the support tube; the size of the support part is a little bigger than the middle part of the metal pillar with the slot, and the support parts are beforehand provided with fixing holes; the two sides of the metal pillar are provided with grooves for the cable to be led out.

6. The slot-fed Yagi aerial of claim 5, wherein the cable passes through the groove at one side of the metal pillar with the slot, and the outer conductor of the cable is connected to the side of the slot, and the inner conductor part with a dielectric layer of the cable passes through the slot to be wound around the groove at the other side of the metal pillar, so as to realize a coupling feed.

7. The slot-fed Yagi aerial of claim 1, wherein the shielded slot structure is composed of a slot provided on the support tube and a metal shield cover surrounding the slot; a clearance is provided between the slot section of the support tube and the inner wall of the metal shield cover.

8. The slot-fed Yagi aerial of claim 7, wherein the two pieces of thin metal rods of the half wavelength dipole are separately connected to the two external sides of the slot section of the support tube; the opposite positions at the two sides of the metal shield cover are provided with via holes for the corresponding thin metal rod to be led out.

9. The slot-fed Yagi aerial of claim 8, wherein the metal shield cover is broken at the position of the via holes for the thin metal rods, and an additional plastic casing pipe is provided at the broken position for connection and waterproof function.

10. The slot-fed Yagi aerial of claim 7, wherein the slot of the shielded slot structure is filled with insulating medium.

11. The slot-fed Yagi aerial of claim 1, wherein in that the slot of the shielded slot structure is filled with insulating medium, and the slot is a linear slot, a S-shaped slot, or an arch shape slot.

* * * * *